US010800062B2

(12) United States Patent
Repac

(10) Patent No.: US 10,800,062 B2
(45) Date of Patent: Oct. 13, 2020

(54) FOOD COMMINUTION DEVICE

(71) Applicant: Genius GmbH, Limburg (DE)

(72) Inventor: Cedomir Repac, Brechen (DE)

(73) Assignee: Genius GmbH, Limburg (DE)

( * ) Notice: Subject to any disclaimer, the term of this patent is extended or adjusted under 35 U.S.C. 154(b) by 361 days.

(21) Appl. No.: 14/654,562

(22) PCT Filed: Dec. 20, 2013

(86) PCT No.: PCT/EP2013/077792
§ 371 (c)(1),
(2) Date: Jun. 22, 2015

(87) PCT Pub. No.: WO2014/102211
PCT Pub. Date: Jul. 3, 2014

(65) Prior Publication Data

US 2015/0343657 A1 Dec. 3, 2015

(30) Foreign Application Priority Data

Dec. 28, 2012 (DE) ..... 10 2012 224 520

(51) Int. Cl.
*B26D 3/18* (2006.01)
*B26D 1/38* (2006.01)
(Continued)

(52) U.S. Cl.
CPC ..... *B26D 3/185* (2013.01); *B26D 1/30* (2013.01); *B26D 1/34* (2013.01); *B26D 1/38* (2013.01);
(Continued)

(58) Field of Classification Search
CPC ... B26D 1/30; B26D 1/38; B26D 3/26; B26D 5/10; B26D 1/02; B26D 1/03; B26D 3/18;
(Continued)

(56) References Cited

U.S. PATENT DOCUMENTS 1,263,151 A 4/1918 Topalian
1,748,997 A * 3/1930 Rentos ..... B26D 1/553 83/407
(Continued)

FOREIGN PATENT DOCUMENTS

DE 20 2009 011 687 U1 12/2009
DE 20 2010 010 796 U1 11/2010
(Continued)

*Primary Examiner* — Jason Daniel Prone
*Assistant Examiner* — Samuel A Davies
(74) *Attorney, Agent, or Firm* — Hodgson Russ LLP

(57) ABSTRACT

The invention relates to a food comminution device having a base part, which has a receptacle for a cutting insert with at least one cutting blade, and having an actuation part, which is articulatedly connected to the base part and which, for pushing through food items for comminution, can be pivoted towards the cutting insert. The food comminution device is characterized in that a cutting insert with mutually spatially separate cutting regions, said cutting regions being separated from one another by an intermediate web, or a cutting insert with an uninterrupted cutting blade arrangement, in particular a cutting blade arrangement which is not interrupted by an intermediate web, or multiple separate cutting inserts simultaneously, in particular cutting inserts each with a separate frame, can be selectively fitted into the receptacle and used.

18 Claims, 5 Drawing Sheets

Figure 1:
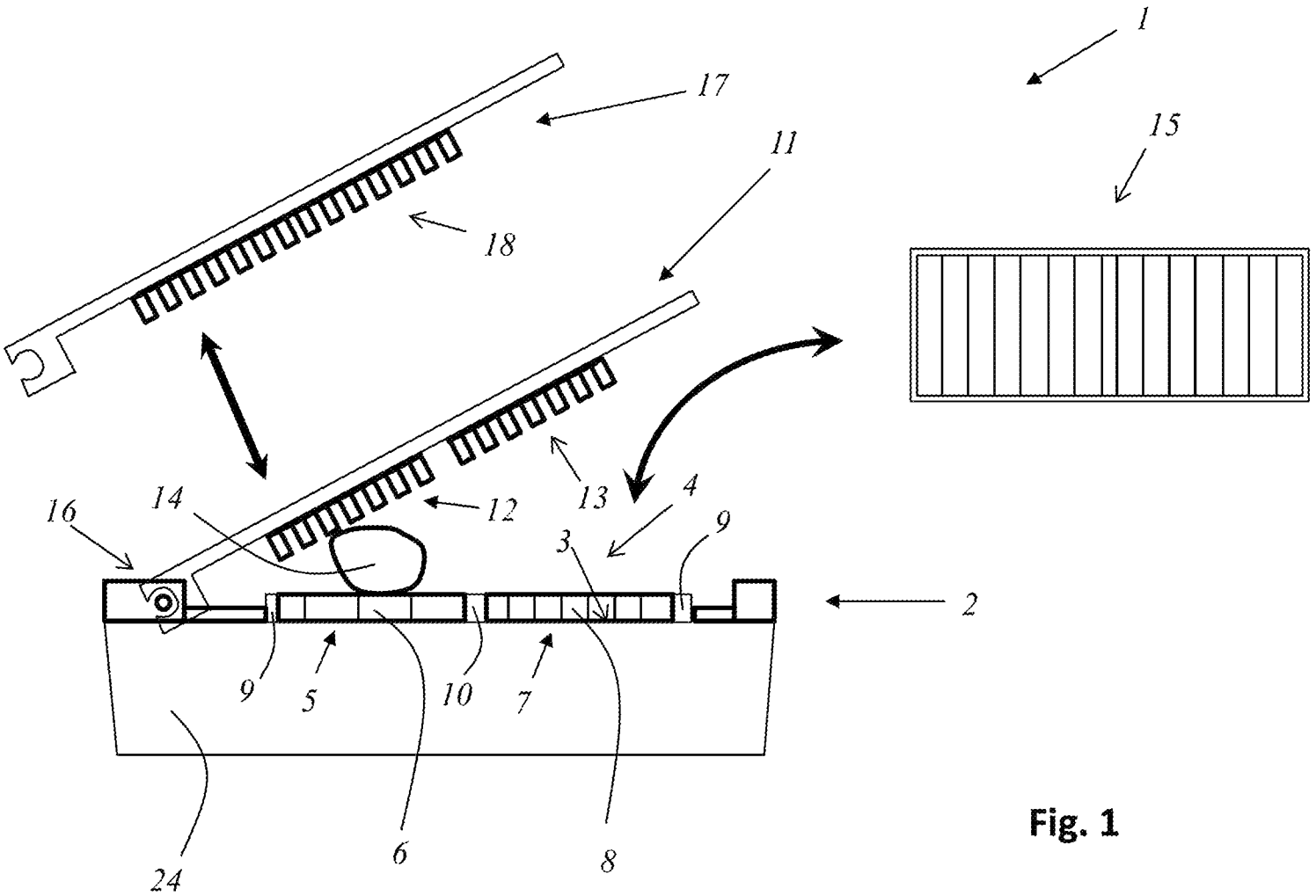

(51) Int. Cl.

| | |
|---|---|
| ***B26D 5/10*** | (2006.01) |
| ***B26D 1/30*** | (2006.01) |
| ***B26D 3/26*** | (2006.01) |
| ***B26D 7/18*** | (2006.01) |
| ***B26D 1/34*** | (2006.01) |
| ***B26D 7/06*** | (2006.01) |
| ***B26D 7/00*** | (2006.01) |

(52) U.S. Cl.
CPC ..... *B26D 3/26* (2013.01); *B26D 5/10* (2013.01); *B26D 7/1818* (2013.01); *B26D 7/0608* (2013.01); *B26D 2007/0018* (2013.01); *Y10T 83/8727* (2015.04)

(58) Field of Classification Search
CPC ..... B26D 3/185; B26D 1/34; B26D 7/0608; B26D 7/1818; B26D 2007/0018; A01C 1/005
USPC ..... 83/167, 932; D7/672, 673, 674
See application file for complete search history.

(56) References Cited

U.S. PATENT DOCUMENTS 4,062,260 A * 12/1977 Steinhogl ..... B26B 5/008 83/404.3
4,545,299 A * 10/1985 Ahner ..... A47J 19/02 100/112
5,692,424 A * 12/1997 Wallace ..... A47J 36/00 83/167
6,470,779 B1 * 10/2002 Gannon ..... B23D 35/008 83/541
D546,638 S * 7/2007 Kaposi ..... D7/672
D548,547 S * 8/2007 Kaposi ..... D7/672
7,669,525 B2 3/2010 Cornfield
D618,517 S * 6/2010 Wong ..... D7/672
2002/0170398 A1 * 11/2002 Verhaeghe ..... B26D 1/553 83/13
2005/0252387 A1 * 11/2005 Cornfield ..... A47J 43/25 99/500
2006/0090352 A1 5/2006 Kaposi
2009/0277343 A1 * 11/2009 Ghimire ..... B26D 3/20 99/537
2010/0011973 A1 * 1/2010 Kovacs ..... B26D 1/0006 99/537
2010/0031830 A1 * 2/2010 Engdahl ..... B26D 1/553 99/538
2012/0231717 A1 * 9/2012 Zean ..... A22C 9/008 452/144
2016/0229075 A1 * 8/2016 Fastabend ..... B26D 1/03

FOREIGN PATENT DOCUMENTS

DE 20 2010 013 110 U1 4/2011
DE 20 2011 050 041 U1 9/2011

* cited by examiner 11
19
22
20
21
23

FOOD COMMINUTION DEVICE

CROSS-REFERENCE TO RELATED APPLICATIONS

The present application is the U.S. national phase of International Application No. PCT/EP2013/077792 filed Dec. 20, 2013, which claims priority of German Application No. 10 2012 224 520.0 filed Dec. 28, 2012, the entirety of which is incorporated herein by reference.

FIELD OF THE INVENTION

The invention relates to a food comminution device having a base part, which has a receptacle for a cutting insert with at least one cutting blade, and having an actuation part, which is articulatedly connected to the base part and which, for pushing through food items to be comminuted, can be pivoted towards the cutting insert.

BACKGROUND OF THE INVENTION

An appliance of this type is known for example from DE 10 2009 023 167 A1. Said document discloses a device for cutting foodstuffs, such as fruit and vegetables, having a cutting insert which has multiple cutting edges, and having an actuation part, said cutting insert and actuation part being mounted so as to be pivotable relative to one another. To cut the items for cutting, the actuation part is pushed towards the cutting insert, wherein the actuation part has a plunger which pushes the items for cutting through the cutting insert, wherein the cutting edges protrude into corresponding depressions of the plunger. The cutting insert has a cutting frame in which cutting blades are held. The device furthermore has a cover part for mounting on a receiving container for the cut items for cutting, wherein the cover part has an opening which forms a passage for the cut items for cutting. Said document discloses only a cutting insert with a continuous, uninterrupted cutting blade arrangement which is surrounded by an outer frame. A cutting insert of said type has the advantage of a relatively large cutting area, but has the disadvantage of low flexibility with regard to cutting patterns that can be used.

DE 20 2011 050 041 U1 has disclosed a particular cutting insert for a food comminution device. The cutting insert has a first cutting blade arrangement in a first region and has a second cutting blade arrangement in a second region that differs from the first region. It may for example be provided that the first cutting blade arrangement has a different blade spacing and/or a different blade orientation and/or a different blade pattern and/or a different blade type than the second cutting blade arrangement. The first cutting blade arrangement and the second cutting blade arrangement are separated from one another by an intermediate web. A cutting insert of said type has the advantage of a high level of flexibility with regard to the available cutting patterns, but has the disadvantage of relatively small cutting areas. The cited document also discloses a food comminution device having an actuating lever on which two pressing plungers are arranged.

SUMMARY OF THE INVENTION

It is the object of the present invention to specify a food comminution device which can be individually adapted to different comminution requirements of different foodstuffs.

The object is achieved by means of a food comminution device which is characterized in that a cutting insert with mutually spatially separate cutting regions, said cutting regions being separated from one another by an intermediate web, or a cutting insert with an uninterrupted cutting blade arrangement, in particular a cutting blade arrangement which is not interrupted by an intermediate web, or multiple separate cutting inserts simultaneously, in particular cutting inserts each with a separate frame, can be selectively fitted into the receptacle and used during a comminution process.

The food comminution device according to the invention has the particular advantage that a wide variety of types of cutting inserts can be used—advantageously also jointly and simultaneously. Accordingly, the user can, in a manner dependent on the present comminution requirements, select whether he or she requires for example an exotic cutting pattern or whether he or she requires for example a large, continuous cutting area for relatively large food items.

According to the invention, it has been identified that the use of different types of cutting inserts is often prevented by the specific form of the respective actuation part. For example, it is normally not possible for an actuation part with a continuous, uninterrupted pressing plunger to be used together with a cutting insert which has two cutting regions separated from one another by an intermediate web, because the intermediate web would prevent the pressing plunger from protruding into the cutting blades. Likewise, it is generally not possible to use an actuation part with two mutually spaced-apart pressing plungers to push an item for cutting through a continuous, uninterrupted cutting insert, because, in the intermediate region between the pressing plungers, no pressure can be exerted on the item for cutting.

This problem can be addressed according to the invention for example by virtue of multiple actuation parts being provided which, interchangeably with one another, can be articulatedly attached to the base part preferably without tools, wherein each of the actuation parts is designed for being used together with a particular cutting insert or with a particular configuration of cutting inserts. According to the invention, it is alternatively also possible to use one and the same actuation part, but with different, preferably removable pressing plungers and/or differently arranged pressing plungers being used on the actuation part. Both options for solving the abovementioned problem will be described in detail below.

In a particular embodiment, multiple actuation parts with mutually different pressing plungers and/or pressing plunger arrangements are provided. In this case, it may be provided in particular that one actuation part is designed for use with a cutting insert with mutually spatially separate cutting regions which are separated from one another by an intermediate web. Alternatively or in addition, it may also be provided that one actuation part is designed for use with a cutting insert with an uninterrupted cutting blade arrangement, in particular a cutting blade arrangement which is not interrupted by an intermediate web, and/or that one actuation part is designed for use with multiple cutting inserts fitted into the receptacle simultaneously, in particular cutting inserts each with a separate frame.

In a particular embodiment of this type, it is provided that the actuation part that is designed for use with a cutting insert with mutually spatially separate cutting regions which are separated from one another by an intermediate web has multiple pressing plungers spaced apart from one another, and/or that the actuation part that is designed for use with a cutting insert with an uninterrupted cutting blade arrangement, in particular a cutting blade arrangement which is not interrupted by an intermediate web, has a single, uninterrupted pressing plunger. Alternatively or in addition, it may also be provided that the actuation part that is designed for use with multiple cutting inserts fitted into the receptacle simultaneously, in particular cutting inserts each with a separate frame, has multiple pressing plungers spaced apart from one another.

An embodiment that can be used in a particularly flexible manner is one in which at least one of the pressing plungers is designed to be removable from the actuation part, and/or in which at least one of the pressing plungers is designed to be exchangeable.

In a particular embodiment, multiple pressing plungers are provided which are fixable or fixed to the actuation part preferably so as to be detachable again without tools. It may alternatively or additionally also be provided that multiple pressing plungers are provided which are fixable or fixed to the actuation part, preferably so as to be detachable again without tools, in different pressing plunger arrangements, and/or that the actuation part has one pressing plunger which can be or is supplemented by a further pressing plunger to form a pressing plunger of a different shape and/or a different size.

Here, it may be provided in particular that one pressing plunger or one pressing plunger arrangement is designed for use with a cutting insert with mutually spatially separate cutting regions which are separated from one another by an intermediate web, and/or that one pressing plunger or one pressing plunger arrangement is designed for use with a cutting insert with an uninterrupted cutting blade arrangement, in particular a cutting blade arrangement which is not interrupted by an intermediate web. Alternatively or in addition, it may also be provided that one pressing plunger or one pressing plunger arrangement is designed for use with multiple cutting inserts fitted into the receptacle simultaneously, in particular cutting inserts each with a separate frame.

In a very particular embodiment, an uninterrupted pressing plunger is formed by joining multiple individual pressing plungers together and/or arranging multiple individual pressing plungers directly adjacent to one another.

It may very particularly advantageously be provided that at least one pressing plunger can be fixed in different positions to the actuation part. It is preferably possible for multiple pressing plungers to each be fixed in different positions to the actuation part. In this way, a multiplicity of different pressing plunger arrangements can be realized.

As already mentioned, the food comminution device may have a cutting insert with mutually spatially separate cutting regions which are separated from one another by an intermediate web. Alternatively or in addition, it may be provided that the food comminution device has a cutting insert with an uninterrupted cutting blade arrangement, in particular a cutting blade arrangement which is not interrupted by an intermediate web.

As already mentioned, it may also be provided that the food comminution device has multiple mutually separate cutting inserts, in particular each with a separate frame, which can be inserted simultaneously and jointly into the receptacle.

Here, it may be provided in particular that the cutting insert with mutually spatially separate cutting regions which are separated from one another by an intermediate web has an encircling frame which surrounds the cutting regions, and/or that the cutting insert with an uninterrupted cutting blade arrangement, in particular a cutting blade arrangement which is not interrupted by an intermediate web, has an encircling outer frame.

In a particular embodiment, it is provided that the cutting insert with mutually spatially separate cutting regions which are separated from one another by an intermediate web is insertable into the base part so as to completely fill the receptacle. Alternatively or in addition, it may also be provided that the cutting insert with an uninterrupted cutting blade arrangement, in particular a cutting blade arrangement which is not interrupted by an intermediate web, is insertable into the base part so as to completely fill the receptacle, and/or that the multiple mutually separate cutting inserts, in particular each with a separate frame, can be inserted simultaneously into the receptacle so as to completely fill the latter. In this way, it is ensured inter alia that no items for cutting can pass into a container for collecting the cut items, for example, having bypassed the cutting insert or the cutting inserts.

A reliable pushing action through the respective cutting insert or the respective cutting inserts can be achieved by virtue of at least one of the pressing plungers having recesses, in particular slots, into which the cutting blades of the cutting insert can protrude during a comminution process.

In particular in order to be able to realize exotic cutting patterns, it may be provided that at least one cutting insert has multiple cutting blades arranged one above the other in different planes, and that at least one pressing plunger is provided for pushing items for comminution through said cutting insert.

In a particular embodiment, the actuation part has a joint head receptacle into which a joint head, which is for example in the form of a peg, of the base part can be received for the purpose of binding the articulated connection. In particular, it may advantageously be provided that the base part, on the one hand, has at least one joint head and the actuation part, on the other hand, has a corresponding joint head receptacle for forming an articulated connection, or that the actuation part, on the one hand, has at least one joint head and the base part, on the other hand, has a corresponding joint head receptacle for forming an articulated connection.

In a very particularly advantageous embodiment, the articulated connection is designed such that the actuation part, at least in a particular pivoting position, in particular in the loading position, is detachable from the base part, in particular exclusively by virtue of the actuation part and base part being pulled apart. The loading position may for example be the position in which the plane of the base part encloses an angle in the range of 80-100°, in particular of 90°, with the plane of the actuation part. The two planes are characterized in that they have a common straight line of intersection which is parallel to the axis of rotation of the actuation part and the base part.

Such an embodiment has the very particular advantage that the actuation part can be easily exchanged for a different actuation part, for example with a different pressing plunger for a different cutting part. A further advantage lies in the fact that the base part and the actuation part can, for example for a cleaning process, be separated from one another easily and preferably without the aid of a tool.

Such tool-free separability of the base part and actuation part may for example be realized by virtue of the joint head receptacle having a radial opening through which the joint head can be removed from or inserted into the joint head receptacle in a radial direction.

The articulated connection is however preferably designed such that separability is provided exclusively in the particular pivoting position, such that outside said pivoting position, an inadvertent detachment of the articulated connection is prevented.

In a very particularly advantageous embodiment, the device has at least one drive device, in particular a spring drive, for assisting or effecting the pivoting movement of the actuation part and/or of the food slicer from a closed position into a loading position and/or from a loading position into a closed position.

A device of said type has in particular the very special advantage that it can be operated using one arm. It may for example be provided that the user uses one hand to place items for comminution onto the cutting part and subsequently uses the other hand to pivot the actuation part towards the cutting part and thus place a spring of a drive device, which is in the form of a spring drive, under stress. Under the action of the force imparted by the stressed spring, the actuation part can, after the comminution process has taken place, move back automatically—that is to say without the user having to hold the base part with one hand—from the closed position into the loading position again. The user can consequently use one hand exclusively for placing further items for comminution onto the cutting part after every comminution process, while using the other hand exclusively for pivoting the actuation part from the loading position into the closed position.

In this way, it is possible for a significantly greater quantity of food items to be processed in the same length of time, because the procedures can be carried out very much more quickly and without the user having to change their grip, which is inconvenient and time-consuming.

In one advantageous embodiment, it is provided that the drive device is selectively activatable or deactivatable and/or that the assistance force of the drive device is adjustable.

A deactivation is preferably realized by virtue of the actuation part being freely pivotable relative to the base part when the drive device is deactivated. It may however also be provided that a deactivation is realized by virtue of pivoting of the actuation part relative to the base part no longer being possible.

The food comminution device may in particular be designed to be placed on a worktop for a comminution process. For example, the food comminution device may have a stand, for example with supporting feet, for placing on a worktop. In particular, a container for collecting the comminuted food items may also be designed, and function, as a stand.

The food comminution device may advantageously be in the form of a cover which can be mounted on a container—preferably so as to completely cover the container opening—and/or can be fixed to a container. The comminuted food item can in this way be safely and reliably collected in the container. In particular, in this way, it is also realized that undesired articles are prevented from passing into the meal in the container. This applies in particular in the case of multiple meals being prepared simultaneously in a kitchen area. Furthermore, removal of the food comminution device after use is not necessary in order to attach a separate cover. This applies in particular in the case of short time intervals between periods of use of the food comminution device.

In a particular embodiment, the base part is in the form of a container for the comminuted food item. Furthermore, a container of said type may also be in the form of a stand for enabling the food comminution device to be placed on a worktop.

However, regardless of whether or not the base part is also in the form of a container, it may also advantageously be provided that the base part is additionally in the form of a stand for enabling the food comminution device to be placed on a worktop or has a stand for enabling the food comminution device to be placed on a worktop.

What is very particularly advantageous is a kitchen appliance which has a container for collecting the comminuted items and a food comminution device according to the invention which is designed as a cover for the container. In this case, it may advantageously be provided in particular that the food comminution device in the form of a cover can be mounted on the container so as to completely cover the container opening. In particular, it may additionally be provided that, for a comminution process, the food comminution device can be fixed temporarily to the container edge, for example by way of a screw connection or by way of a detent connection.

It is advantageously possible for the kitchen appliance to be designed to be placed on a worktop for a comminution process.

It may for example be provided that the container of the kitchen appliance is in the form of a stand for enabling the food comminution device to be placed on a worktop. For example, supporting feet, in particular non-slip supporting feet composed of rubber or some other elastic material, may be arranged on the outer side of the base of the container.

BRIEF DESCRIPTION OF THE DRAWING VIEWS

The subject matter of the invention is schematically illustrated in the drawing and will be described below on the basis of the figures, wherein identical elements or elements of identical action are normally denoted by the same reference signs.

Figures 2, 3, 4:
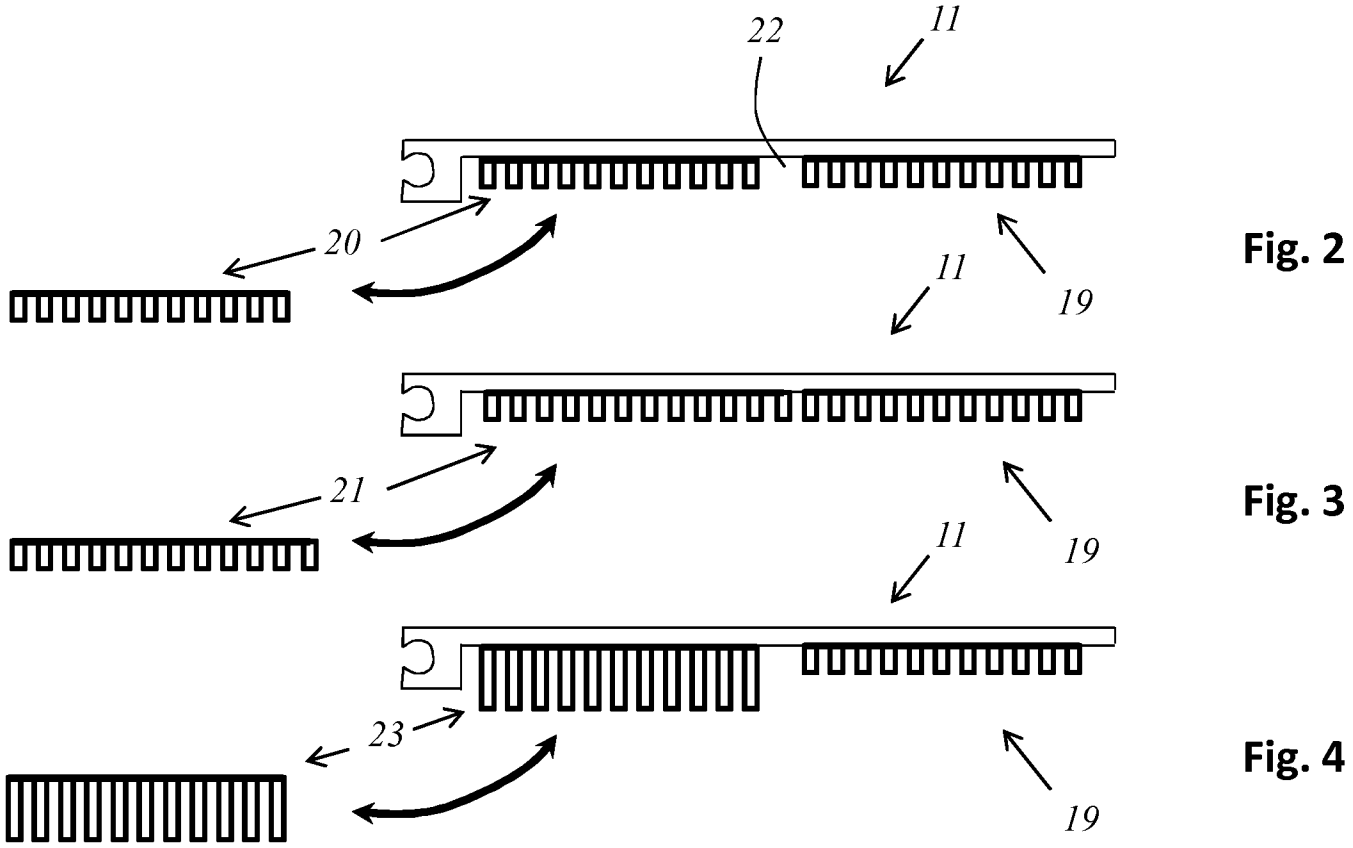
Figure 5:
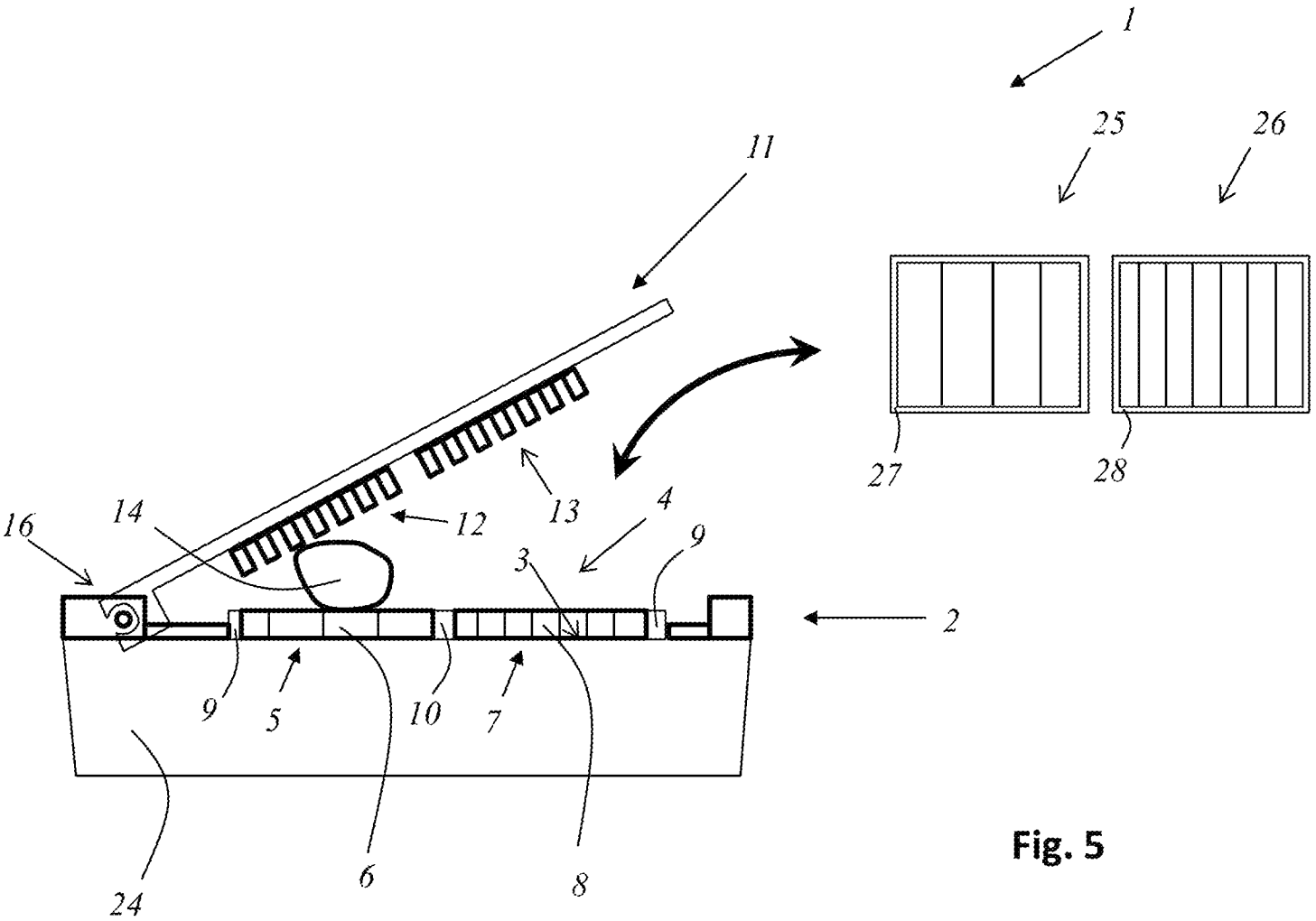
Figure 6:
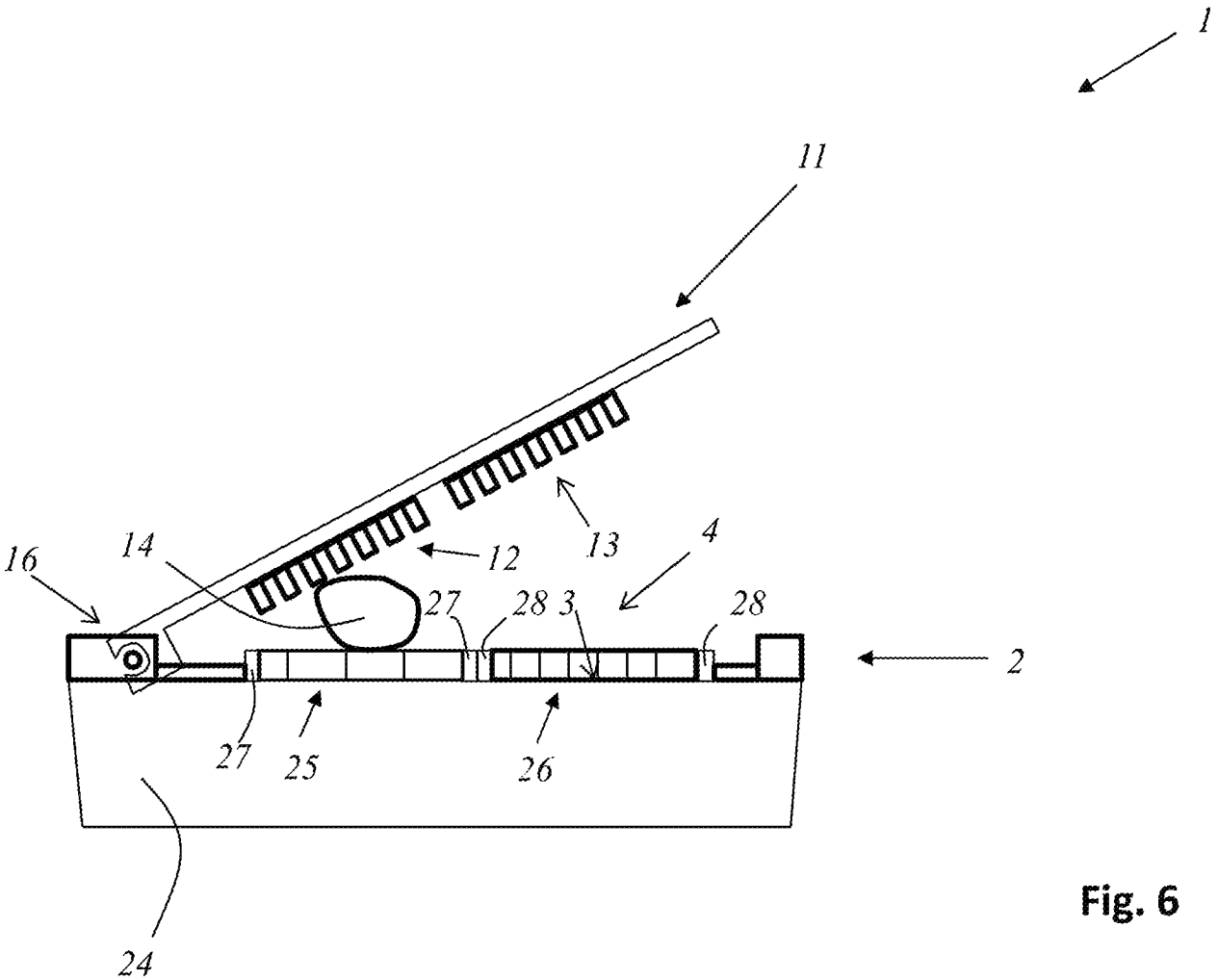
Figure 7:
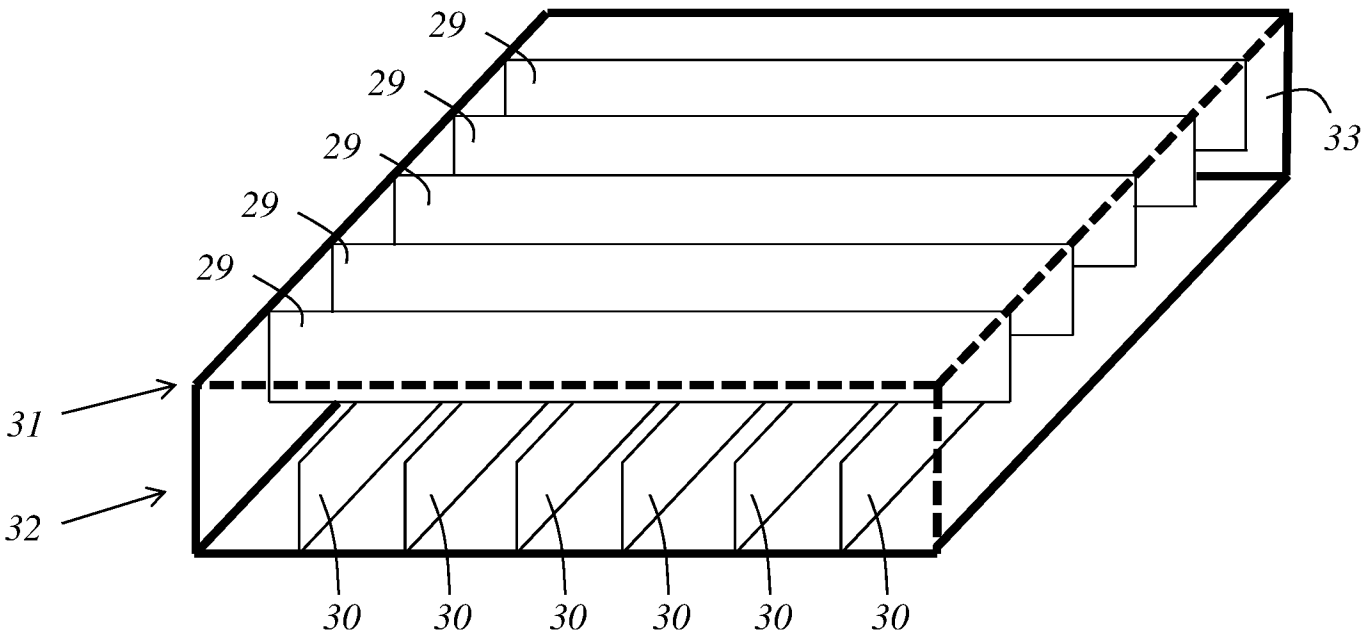

In the drawing:

FIG. 1 shows an exemplary embodiment of a food comminution device according to the invention, FIG. 2 shows, by way of example, the formation of an actuation part that can be used with a particular cutting insert, FIG. 3 shows, by way of example, the formation of another actuation part that can be used with another cutting insert FIG. 4 shows, by way of example, the formation of a further actuation part that can be used with a further cutting insert;

FIG. 5 illustrates that the first cutting insert of the food comminution device shown in FIG. 1 can be replaced by multiple separate cutting inserts, each having a frame, FIG. 6 shows the food comminution device with separate cutting inserts, each having a frame, received into a receptacle, and FIG. 7 shows a cutting insert which has multiple cutting blades arranged one above the other in different planes.

DETAILED DESCRIPTION OF THE INVENTION

FIG. 1 shows an exemplary embodiment of a food comminution device 1 according to the invention which has a base part 2 with a receptacle 3. A first cutting insert 4 is fitted into the receptacle 3. The first cutting insert 4 has a first cutting blade arrangement 6 in a first cutting region 5 and has a second cutting blade arrangement 8 in a second cutting region 7. The first cutting blade arrangement 6 and the second cutting blade arrangement 8 are arranged in a common frame 9 and are separated from one another by an intermediate web 10.

The food comminution device 1 furthermore has an actuation part 11 which is articulatedly connected to the base part 2 and which, for pushing through food items for comminution, can be pivoted towards the cutting insert 4. A first pressing plunger 12 and a second pressing plunger 13 are fixed to the actuation part 11 such that items for comminution 14 can be pushed through the first cutting blade arrangement 6 by means of the first pressing plunger 12 and such that items for comminution can (alternatively or additionally) be pushed through the second cutting blade arrangement 8 by means of the second pressing plunger 13.

According to the invention, the first cutting insert 4 can be replaced with a second cutting insert 15 which has an uninterrupted cutting blade arrangement, in particular a cutting blade arrangement which is not interrupted by an intermediate web 10, this replacement being illustrated in the FIG. 1 by the curved double arrow. The first cutting insert 4 is illustrated in the figure in a horizontal position, that is to say so as to be visible only from the side, whereas the second cutting insert 15 is illustrated in an upright position. It is self-evident that the second cutting insert 15 must be rotated through 90 degrees in order to be inserted into the receptacle 3.

To ensure that items for comminution are pushed through the second cutting insert 15 without problems, provision is made for the articulated connection 16 of the base part 2 to the actuation part 11 to be detached, and for the actuation part 11 to be replaced with a different actuation part 17 which has a different pressing plunger 18 which is specifically adapted to the cutting blade spacing of the second cutting insert 15.

The food comminution device 1 is in the form of a cover which can be mounted onto a container 24 with detent action and so as to completely cover the container opening. After all of the food items for processing have been pushed through the respective cutting insert 4, 15, the food comminution device 1 can be removed from the container 24, for example in order for the container 24 to be emptied.

As an alternative to an exchange of the actuation part 11 for a different actuation part 17, it would be possible to use an actuation part on which different pressing plunger configurations can be produced, for example by virtue of pressing plungers being fixed in different positions and/or through the use of different pressing plungers. This facility will be described below on the basis of FIGS. 2 to 4.

According to the invention, the first cutting insert 4 can be replaced with separate cutting inserts 25, 26, each having a frame 27, 28. This replacement is illustrated in the FIG. 5 by the curved double arrow. The first cutting insert 4 is illustrated in the figure in a horizontal position, that is to say so as to be visible only from the side, whereas the separate cutting inserts 25, 26, each having a frame 27, 28 are illustrated in an upright position. It is self-evident that the separate cutting inserts 25, 26 must be rotated through 90 degrees in order to be inserted into the receptacle 3. FIG. 6 shows the food comminution device 1 with separate cutting inserts 25, 26 received into the receptacle 3.

FIG. 2 shows, by way of example, the formation of an actuation part 11 which is designed for use with a cutting insert which has two mutually spatially separate cutting regions that are separated by an intermediate web. It would also be possible for the actuation part 11 to be used together with two mutually separate cutting inserts inserted jointly and simultaneously into a receptacle of a base part.

A pressing plunger 19 is fixed to the actuation part 11. Furthermore, a further pressing plunger 20 is fixed to the actuation part 11, as illustrated by the curved double arrow. The further pressing plunger 20 is preferably fixable to the actuation part 11 by way of a simple plug-type and/or detent connection.

The pressing plunger 19 and the further pressing plunger 20 are spaced apart from one another by an intermediate space 22 for the intermediate web.

The actuation part 11 illustrated in FIG. 2 may be converted for use with a cutting insert which has a continuous cutting area that is not interrupted by an intermediate web. For this purpose, the further pressing plunger 20 is removed and replaced with a third pressing plunger 21. The third pressing plunger 21 is larger than the further pressing plunger 20 and is designed such that it also fills the originally existing intermediate space 22. This process is illustrated in FIG. 3.

FIG. 4 illustrates that the actuation part 11 may also be fitted with a pressing plunger which is capable of pushing food items for comminution through a cutting blade arrangement which has multiple cutting blades arranged one above the other in different planes. For this purpose, a fourth pressing plunger 23 which is of particularly tall form is fixed to the actuation part 11. The actuation part 11 illustrated in FIG. 4 is designed for being used together with a cutting insert which has different cutting regions that are separated from one another by an intermediate web, wherein one of the cutting regions has cutting blades arranged one above the other in different planes.

FIG. 7 shows a cutting insert which has a frame 33 and which has multiple cutting blades 29, 30 arranged one above the other in different planes 31, 32.

LIST OF REFERENCE NUMERALS

1 Food comminution device
2 Base part
3 Receptacle
4 First cutting insert
5 First cutting region
6 First cutting blade arrangement
7 Second cutting region
8 Second cutting blade arrangement
9 Frame
10 Intermediate web
11 Actuation part
12 First pressing plunger
13 Second pressing plunger
14 Item for comminution
15 Second cutting insert
16 Articulated connection
17 Other actuation part
18 Other pressing plunger
19 Pressing plunger
20 Further pressing plunger
21 Third pressing plunger
22 Intermediate space
23 Fourth pressing plunger
24 Container
25 cutting insert
26 cutting insert
27 Frame
28 Frame
29 Blade
30 Blade
31 Plane 32 Plane
33 Frame

What is claimed is:

1. A food comminution kit comprising:

a food comminution device (1) comprising a base part (2) having a receptacle (3), wherein the food comminution device (1) further comprises an actuation part (11) articulatedly connected to the base part (2) to pivot relative to the base part (2), the actuation part including an initial pressing plunger (19) fixed thereto;

a cutting insert kit consisting of a plurality of interchangeable cutting inserts (4, 15) each selectable by a user for use during a comminution process by placement of the cutting insert into the receptacle, each of the plurality of interchangeable cutting inserts having at least one cutting blade arrangement (6, 8), wherein the plurality of interchangeable cutting inserts includes a first cutting insert (4) having spatially separate cutting regions (5, 7) separated from one another by an intermediate web (10), and a second cutting insert (15) having an uninterrupted cutting blade arrangement which is not interrupted by an intermediate web; and a pressing plunger kit consisting of a plurality of interchangeable pressing plungers (20, 21) each selectable by a user for use during a comminution process by fixing the pressing plunger to the actuation part (11), wherein the plurality of interchangeable pressing plungers includes a first pressing plunger (20) fixable to the actuation part (11) such that the first pressing plunger (20) is spaced apart from the initial pressing plunger (19) by an intermediate space (22) large enough to accommodate the intermediate web (10), and a second pressing plunger (21) fixable to the actuation part (11) such that the second pressing plunger (21) is not spaced apart from the initial pressing plunger (19) on the actuation part (11) by the intermediate space (22);

wherein, when the first cutting insert (4) is received by the receptacle (3) and the first pressing plunger (20) is fixed to the actuation part (11), the actuation part (11) pivots toward the first cutting insert such that the first pressing plunger (20) and the initial pressing plunger (19) push food items to be comminuted through the first cutting insert (4) and the intermediate web (10) of the first cutting insert is accommodated in the intermediate space (22) between the first pressing plunger (20) and the initial pressing plunger (19), whereby an entire cutting area defined by the spatially separate cutting regions (5, 7) of the first cutting insert (4) is usable for comminution by pivoting the actuation part (11);

wherein, when the second cutting insert (15) is received by the receptacle (3) and the second pressing plunger (21) is fixed to the actuation part (11), the actuation part (11) pivots toward the second cutting insert (15) such that the second pressing plunger (21) and the initial pressing plunger (19) push food items to be comminuted through the second cutting insert (15), whereby an entire cutting area defined by the uninterrupted cutting blade arrangement of the second cutting insert is usable for comminution by pivoting the actuation part (11).

2. The food comminution kit according to claim 1, wherein each of the plurality of interchangeable cutting inserts (4, 15) is sized to completely fill the receptacle (3) when received by the receptacle (3).

3. The food comminution kit according to claim 1, wherein the plurality of interchangeable pressing plungers (20, 21) have recesses into which the cutting blade arrangement of the cutting insert received by the receptacle (3) can protrude during a comminution process.

4. The food comminution kit according to claim 1, wherein at least one of the plurality of interchangeable cutting inserts has multiple cutting blades (29, 30) arranged one above the other in a direction of comminution in different planes (31, 32), and the plurality of interchangeable pressing plungers includes at least one pressing plunger (23) configured for cooperation with the cutting insert having multiple cutting blades arranged one above the other in the direction of comminution in different planes.

5. The food comminution kit according to claim 1, wherein the base part (2) is formed as a container for receiving the comminuted food items.

6. The food comminution kit according to claim 1, wherein the base part (2) includes a stand for enabling the food comminution device to be placed on a worktop.

7. A food comminution kit comprising:

a base part (2) having a receptacle (3);

an actuation part (11) articulatedly connected to the base part (2) to pivot relative to the base part (2), the actuation part including a first pressing plunger (12) and a second pressing plunger (13);

a cutting insert kit consisting of a plurality of interchangeable cutting inserts (4, 25, 26) each selectable by a user for use during a comminution process by placement of the cutting insert into the receptacle, each of the plurality of interchangeable cutting inserts having at least one cutting blade arrangement (6, 8), wherein the plurality of interchangeable cutting inserts includes a first cutting insert (4) having spatially separate cutting regions (5, 7) separated from one another by an intermediate web (10), and multiple separate cutting inserts (25, 26) simultaneously fittable into the receptacle (3), each of the multiple separate cutting inserts having a separate frame (27, 28); and wherein, when the first cutting insert (4) is received by the receptacle (3), the actuation part (11) pivots toward the first cutting insert such that the first pressing plunger (12) and the second pressing plunger (13) respectively push food items to be comminuted through the spatially separate cutting regions (5, 7) of the first cutting insert (4), whereby an entire cutting area defined by the spatially separate cutting regions (5, 7) of the first cutting insert (4) is usable for comminution by pivoting the actuation part (11);

wherein, when the multiple separate cutting inserts (25, 26) are simultaneously received by the receptacle (3) such that no cutting area of the multiple separate cutting inserts (25, 26) overlaps another cutting area of the multiple separate cutting inserts (25, 26), the actuation part (11) pivots toward the multiple separate cutting inserts (25, 26) such that the first pressing plunger (12) and the second pressing plunger (13) respectively push food items to be comminuted through the multiple separate cutting inserts (25, 26), whereby an entire cumulative cutting area within the frames (27, 28) of the multiple separate cutting inserts (25, 26) is usable for comminution by pivoting the actuation part (11).

8. The food comminution kit according to claim 7, wherein the first cutting insert (4) is sized to completely fill the receptacle (3) when received by the receptacle (3).

9. The food comminution kit according to claim 7, wherein at least one of the first pressing plunger (12) and the second pressing plunger (13) has recesses into which the cutting blade arrangement of at least one cutting insert received by the receptacle (3) can protrude during a comminution process.

10. The food comminution kit according to claim 7, wherein at least one of the plurality of interchangeable cutting inserts has multiple cutting blades (29, 30) arranged one above the other in different planes (31, 32), and at least one of the first pressing plunger and the second pressing plunger is configured for cooperation with the cutting insert having multiple cutting blades arranged one above the other in different planes.

11. The food comminution kit according to claim 7, wherein the base part (2) is formed as a container for receiving the comminuted food items.

12. The food comminution kit according to claim 7, wherein the base part (2) includes a stand for enabling the food comminution device to be placed on a worktop.

13. A food comminution kit comprising:

a base part (2) having a receptacle (3);

an actuation part (11) articulatedly connected to the base part (2) to pivot relative to the base part (2), the actuation part including an initial pressing plunger (19) fixed thereto;

a cutting insert kit consisting of a plurality of interchangeable cutting inserts (15, 25, 26) each selectable by a user for use during a comminution process by placement of the cutting insert into the receptacle, each of the plurality of interchangeable cutting inserts having at least one cutting blade arrangement (6, 8), wherein the plurality of interchangeable cutting inserts includes a first cutting insert (15) having an uninterrupted cutting blade arrangement which is not interrupted by an intermediate web, and multiple separate cutting inserts (25, 26) simultaneously fittable into the receptacle (3), each of the multiple separate cutting inserts having a separate frame (27, 28); and a pressing plunger kit consisting of a plurality of interchangeable pressing plungers (21, 20) each selectable by a user for use during a comminution process by fixing the pressing plunger to the actuation part (11), wherein the plurality of interchangeable pressing plungers includes a first pressing plunger (21) fixable to the actuation part (11) such that the first pressing plunger (21) is not spaced apart from the initial pressing plunger (19) on the actuation part (11) by an intermediate space large enough to accommodate adjacent portions of the cutting insert frames (27, 28), and a second pressing plunger (20) fixable to the actuation part (11) such that the second pressing plunger (20) is spaced apart from the initial pressing plunger (19) on the actuation part (11) by an intermediate space large enough to accommodate adjacent portions of the cutting insert frames (27, 28);

wherein, when the first cutting insert (15) is received by the receptacle (3) and the first pressing plunger (21) is fixed to the actuation part (11), the actuation part (11) pivots toward the first cutting insert such that the first pressing plunger (21) and the initial pressing plunger (19) push food items to be comminuted through the first cutting insert (15), whereby an entire cutting area defined by the uninterrupted cutting blade arrangement of the first cutting insert (15) is usable for comminution by pivoting the actuation part (11);

wherein, when the multiple separate cutting inserts (25, 26) are simultaneously received by the receptacle (3) in a plane of the receptacle (3) and the second pressing plunger (20) is fixed to the actuation part (11), the actuation part (11) pivots toward the multiple separate cutting inserts (25, 26) such that the second pressing plunger (20) and the initial pressing plunger (19) push food items to be comminuted through the multiple separate cutting inserts (25, 26), whereby an entire cumulative cutting area within the frames (27, 28) of the multiple separate cutting inserts (25, 26) is usable for comminution by pivoting the actuation part (11).

14. The food comminution kit according to claim 13, wherein The first cutting insert (15) is sized to completely fill the receptacle (3) when received by the receptacle (3).

15. The food comminution kit according to claim 13, wherein the plurality of interchangeable pressing plungers (21, 20) have recesses into which the cutting blade arrangement of at least one cutting insert received by the receptacle (3) can protrude during a comminution process.

16. The food comminution kit according to claim 13, wherein at least one of the plurality of interchangeable cutting inserts has multiple cutting blades (29, 30) arranged one above the other in a direction of comminution in different planes (31, 32), and the plurality of interchangeable pressing plungers includes at least one pressing plunger (23) configured for cooperation with the cutting insert having multiple cutting blades arranged one above the other in the direction of comminution in different planes.

17. The food comminution kit according to claim 13, wherein the base part (2) is formed as a container for receiving the comminuted food items.

18. The food comminution kit according to claim 13, wherein the base part (2) includes a stand for enabling the food comminution device to be placed on a worktop.

* * * * *